United States Patent [19]

Klaue

[11] 4,195,612

[45] Apr. 1, 1980

[54] MULTICYLINDER TWO-STROKE INTERNAL COMBUSTION ENGINE WITH ROTARY DISTRIBUTOR

[76] Inventor: Hermann Klaue, Case Postale 151 Tour d'Ivoire 24e, CH—1820 Montreaux, Switzerland

[21] Appl. No.: 860,945

[22] Filed: Dec. 15, 1977

[30] Foreign Application Priority Data

Dec. 15, 1976 [DE] Fed. Rep. of Germany ..... 2656681

[51] Int. Cl.[2] ..... F01L 7/00; F02B 75/26; F02B 33/04

[52] U.S. Cl. ..... 123/190 BA; 123/190 AA; 123/58 B; 123/73 A; 123/80 BB

[58] Field of Search ..... 123/58 R, 58 B, 58 BA, 123/58 BB, 58 BC, 58 AB, 73 R, 73 A, 73 B, 73 AB, 73 V, 80 R, 80 BB, 82, 190 R, 190 AA, 190 BA, 190 BB

[56] References Cited

U.S. PATENT DOCUMENTS

| | | | |
|---|---|---|---|
| 1,774,713 | 9/1930 | Jahn et al. | 123/190 BB |
| 1,844,386 | 2/1932 | Harris et al. | 123/58 BA |
| 2,019,043 | 10/1935 | Braunwalder | 123/190 BA |
| 2,242,871 | 5/1941 | Raab et al. | 123/73 V |
| 2,246,446 | 6/1941 | Kylen | 123/73 AB |
| 2,270,546 | 1/1942 | Neuland | 123/73 A |
| 2,403,282 | 7/1946 | Holmes | 123/190 BA |
| 2,966,899 | 1/1961 | Herrmann | 123/58 AB |

*Primary Examiner*—Charles J. Myhre
*Assistant Examiner*—M. Moy
*Attorney, Agent, or Firm*—Larson, Taylor and Hinds

[57] ABSTRACT

A multicylinder two-stroke internal combustion engine has a plurality of reciprocating pistons arranged in a circle about a central cavity in which is located a rotary distributor driven in timed sequence with operation of the pistons. The rotary distributor includes internal cavities which may connect through ports in its outer cylindrical surface with the working cylinders to control the flow of intake air, scavenging air and/or fuel to the working cylinders. Scavenging air can be precompressed either in a preceding cylinder, taken in ignition order, or in the crank chambers beneath the pistons.

28 Claims, 12 Drawing Figures

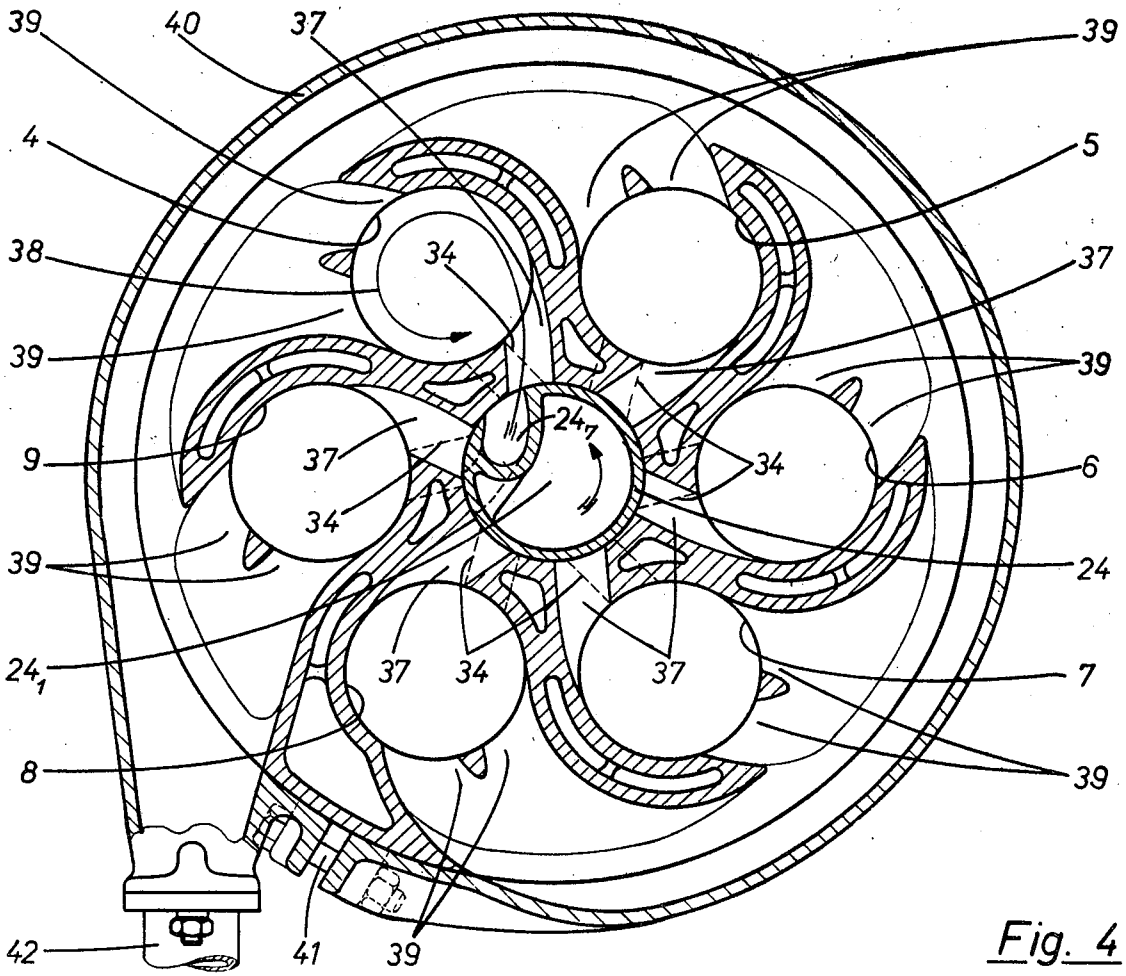
Fig. 4 E-F

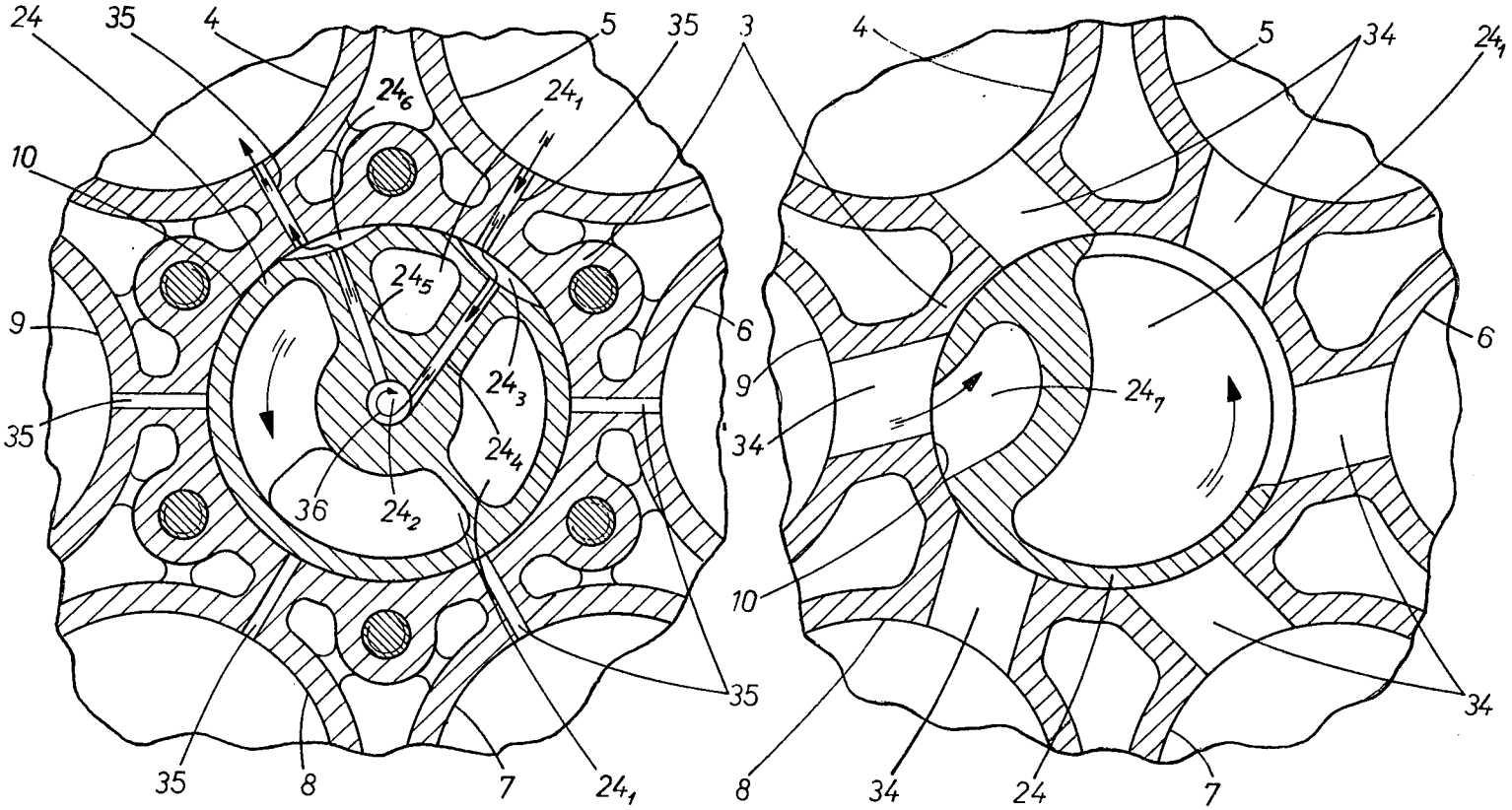
Fig. 6 (J-K)
Fig. 5 (G-H)

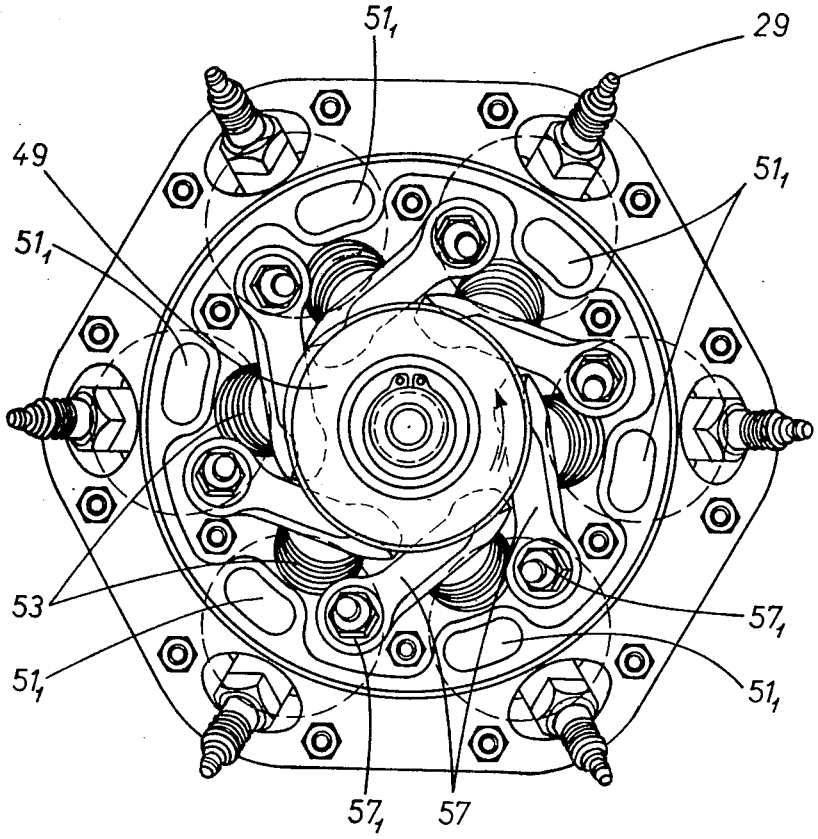
Fig. 8
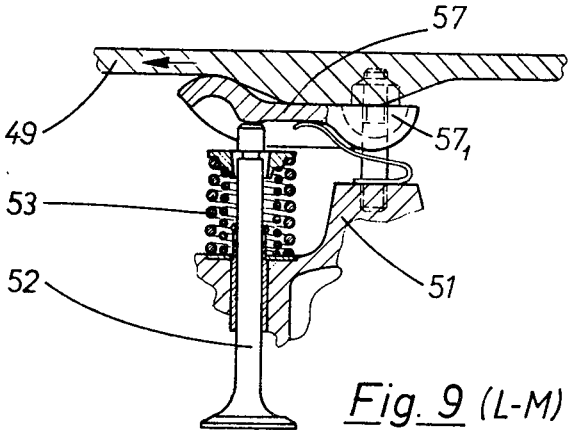
Fig. 9 (L-M)

MULTICYLINDER TWO-STROKE INTERNAL COMBUSTION ENGINE WITH ROTARY DISTRIBUTOR

Two-stroke internal combustion engines are of course well known. While this type of engine has not been in widespread use for automotive vehicles, it appears that this type of engine has characteristics which could result in its being reintroduced into extensive use because of exhaust emission regulations in all industrialized countries. Under specific conditions, it is precisely engines of this structural type that can meet the rigid NOx regulations without a downstream converter. Two-stroke engines as opposed to four-stroke Otto engines, offer the advantage of less bulk and higher specific output. However, a condition for their utilization consists in changing their combustion process so that the hydrocarbon fractions will be reduced in the exhaust and in that there will be air scavenging. Such a multicylinder two-stroke combustion engine is the subject of the invention.

According to the invention, in a multicylinder combustion engine in which the working cylinders are disposed, equiangularly spaced from each other in a circle, there is provided a rotary distributor disposed in the central cavity of the circle, reaching to the cylinder head and rotating in timed sequence with the piston strokes, controlling one or more combustion process functions of the working cylinders via control ports in the inner cylindrical surface of the housing containing the working cylinders, as well as on the outer cylindrical surface of the rotary distributor.

The invention may also include interconnected channels going out to the outer cylindrical surface of the rotary distributor, in which fuel is injected via a fuel supply led into a chamber in th distributor and joined therewith. Between the rotary distributor and the working cylinders, conduits are provided in the housing, the openings of which are disposed in such a way that their cooperation with the distributor ports, by the motion of the distributor, results in a connection between the working cylinder of the working piston that is at the beginning of the compression stroke and the cylinder of the working piston that leads in the ignition order. Such an arrangement is described in greater detail in my co-pending U.S. Patent Application Ser. No. 847,801, filed Nov. 2, 1977. Abandoned. A further advantage of this arrangement is that scavenging can be effected. The fuel is introduced into the rotary distributor by continuous low-pressure injection, whereby a pre-compressed mixture fraction can be taken from the cylinder chamber of the leading piston. The fuel thereby is prepared in such a way that there is a rich mixture in which the fuel, as a result of the suitably heated highly compressed mixture fraction is delivered to the working cylinder is a vaporized state. There the second stage of mixture formation takes place, by mixing the rich mixture fraction with the scavenging air.

The present invention may also include an arrangement wherein the cylinder crank chambers serve for pre-compression of the combustion air, and it is additionally proposed that in the scavenging and charging process each working cylinder be connected via the rotary distributor with the crank chamber of the piston following the piston of the cylinder that is to be supplied with combustion air, and start of scavenging is controlled by the rotary distributor.

Hereby the gas control is asymmetrical, i.e. air is still delivered when the starting ports are already closed. Because the fuel will only be delivered to the cylinder after closure of the ports, there is no more fuel loss. The hydrocarbon fraction of the exhaust will thus be reduced at least to the value found in four-stroke engines.

Because the fresh gas conduits in the engine of the invention are not only equal for the individual cylinders but also are very short by virtue of the central position of the controlling rotary distributor, there are only relatively small dead spaces and low flow losses, whereby efficiency and high speed characteristics of the engine are enhanced.

In accordance with another alternative of the invention, the crank chamber intake may also be controlled by the rotary distributor. Here again as in the above mentioned arrangements the central position of the rotary distributor is an advantage. All conduits that supply the combustion process are short and of equal length.

Moreover, according to a preferred embodiment of the present invention, there are six cylinders, each two cylinders operatively connected to a crank shaft, and the three crank shafts being interconnected by gears or chains. The rotary distributor is driven by the middle crank shaft via bevel gears or the like.

In another embodiment of the invention, discharge from the working cylinders can be controlled by valves, whereas the intake is controlled by intake ports, via the rotary distributor. The valves are actuated by a cam disposed on an extension of the rotary distributor. In this way, as in the case of engines controlled solely by ports, the combustion air can be led through the rotary distributor face, on the side toward the cylinder head. According to the invention moreover, the delivery conduits for combustion air disposed in the rotary distributor may be made helicoidal, so that their configuration will increase the delivery of the crank chambers. Finally, in a further development of the invention, the lift pistons can be connected via rods to a wobble plate rather than to crank shafts, and the rotary distributor can be coupled directly with the wobble plate.

Hence, it is an object of this invention to provide a new and improved multicylinder two-stroke engine, especially one wherein noxious control emissions will be reduced.

It is still another object of this invention to provide a two-stroke multicylinder engine having the cylinders arranged in a circle and wherein the central space includes a rotary distributor for controlling one or more functions of the working cylinders.

These and other objects of the invention will become more apparent from the detailed description of the following preferred embodiments of the invention, taken together with the accompanying drawings.

Referring now to the drawings, FIGS. 1 through 6 show a six-cylinder two-stroke combustion engine in which both the intake and the discharge are controlled by ports while FIGS. 7 through 9 illustrate a similar engine wherein the discharge is controlled by valves and FIG. 10 illustrates a similar type of engine utilizing a wobble plate drive, while FIGS. 11 and 12 are control diagrams.

More specifically:

FIG. 4 is a horizontal sectional view taken along line E–F of FIG. 2.

FIG. 5 is a partial horizontal sectional view taken along line G–H of FIG. 2.

FIG. 6 is a partial horizontal sectional view taken along line J–K of FIG. 2.

FIG. 8 is a top plan view of FIG. 7 with the valve cover removed to illustrate the valves.

FIG. 9 is a partial sectional view taken along line L–M of FIG. 7.

Referring now to the drawings, like elements will be identified by like numerals throughout the several views.

Figure 1:
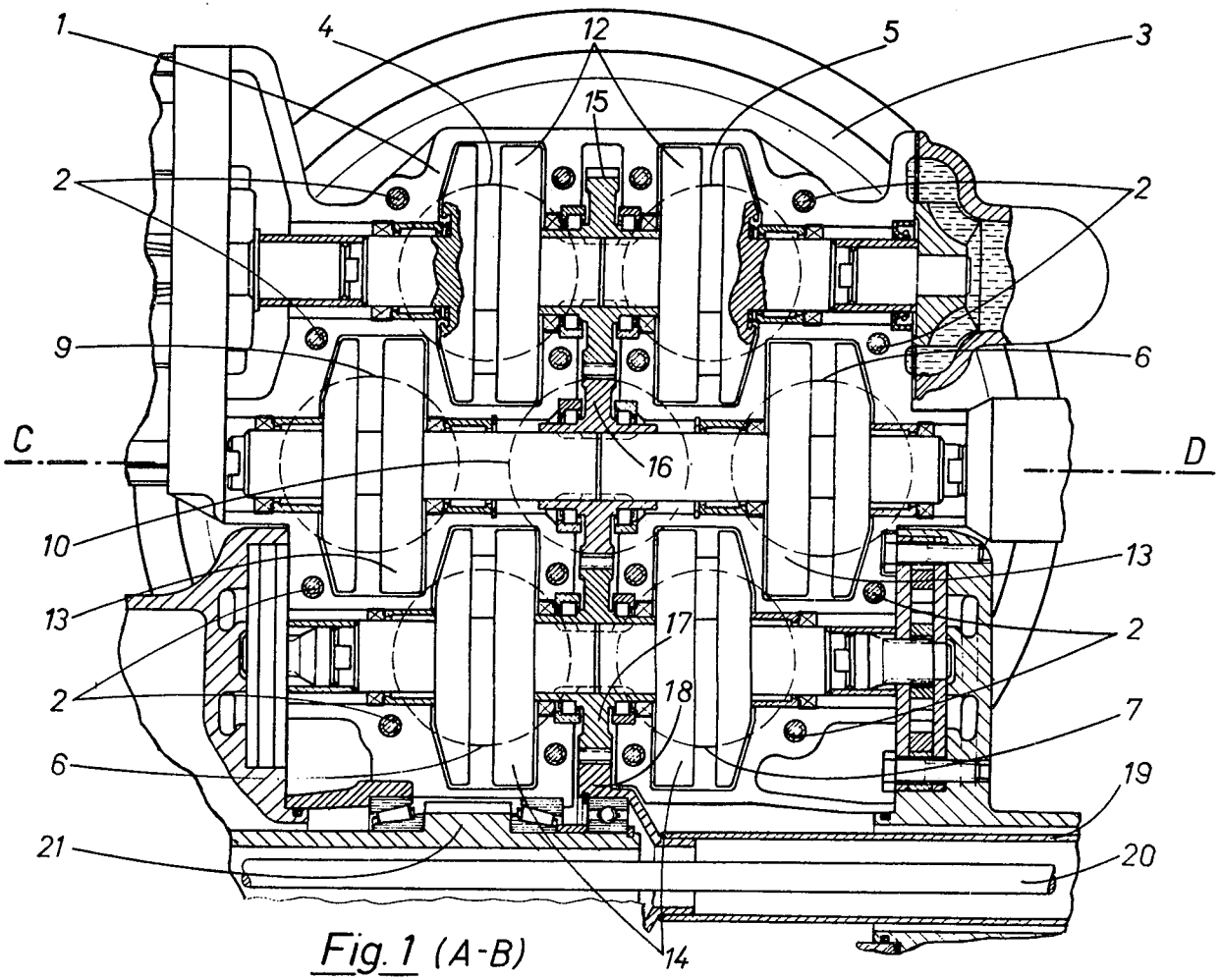
FIG. 1 is a horizontal sectional view taken along line A–B of FIG. 2 and showing the three crank shafts of the engine.
Figure 2:
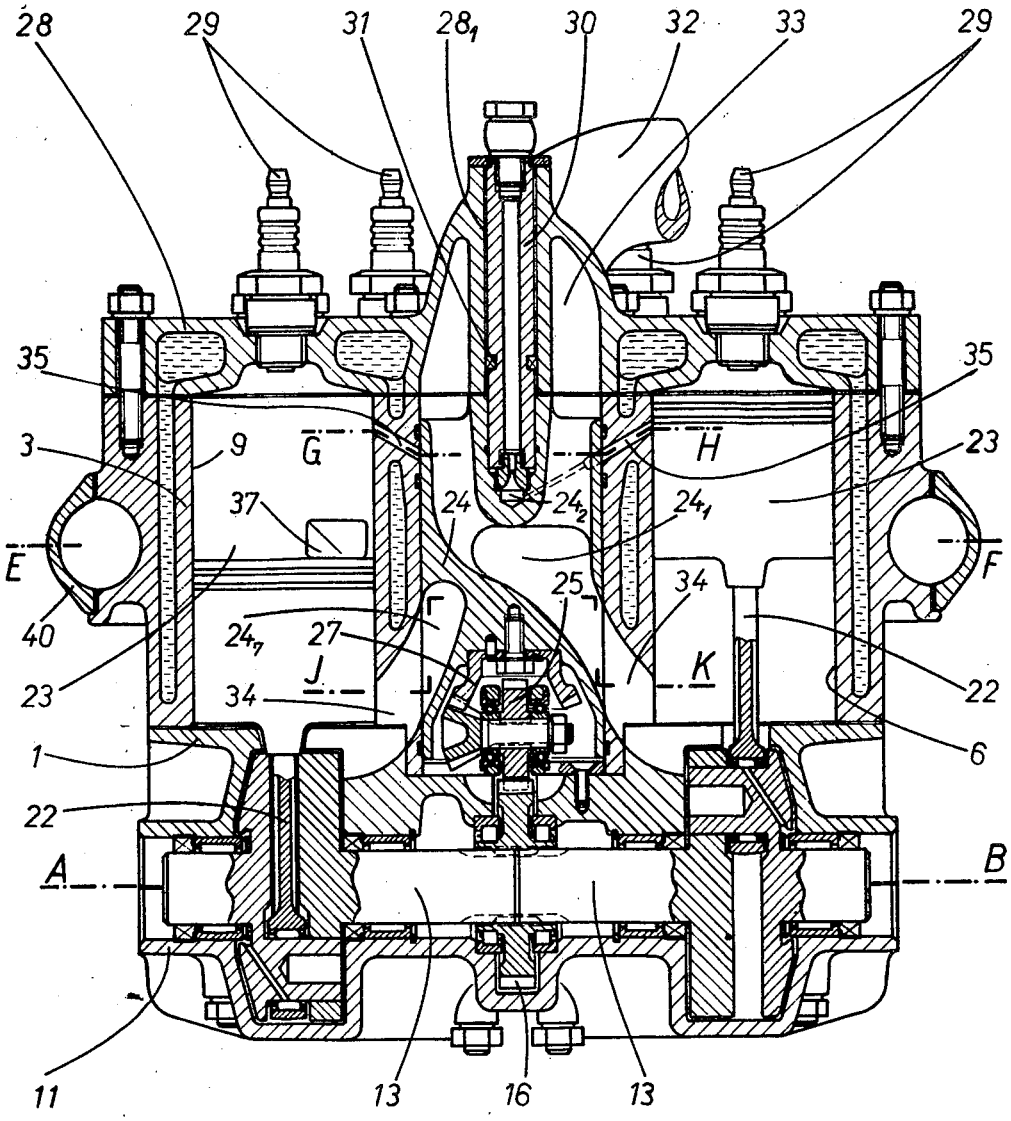
FIG. 2 is a vertical sectional view through a two-stroke multicylinder engine taken along line C–D of FIG. 1.
Figure 3:
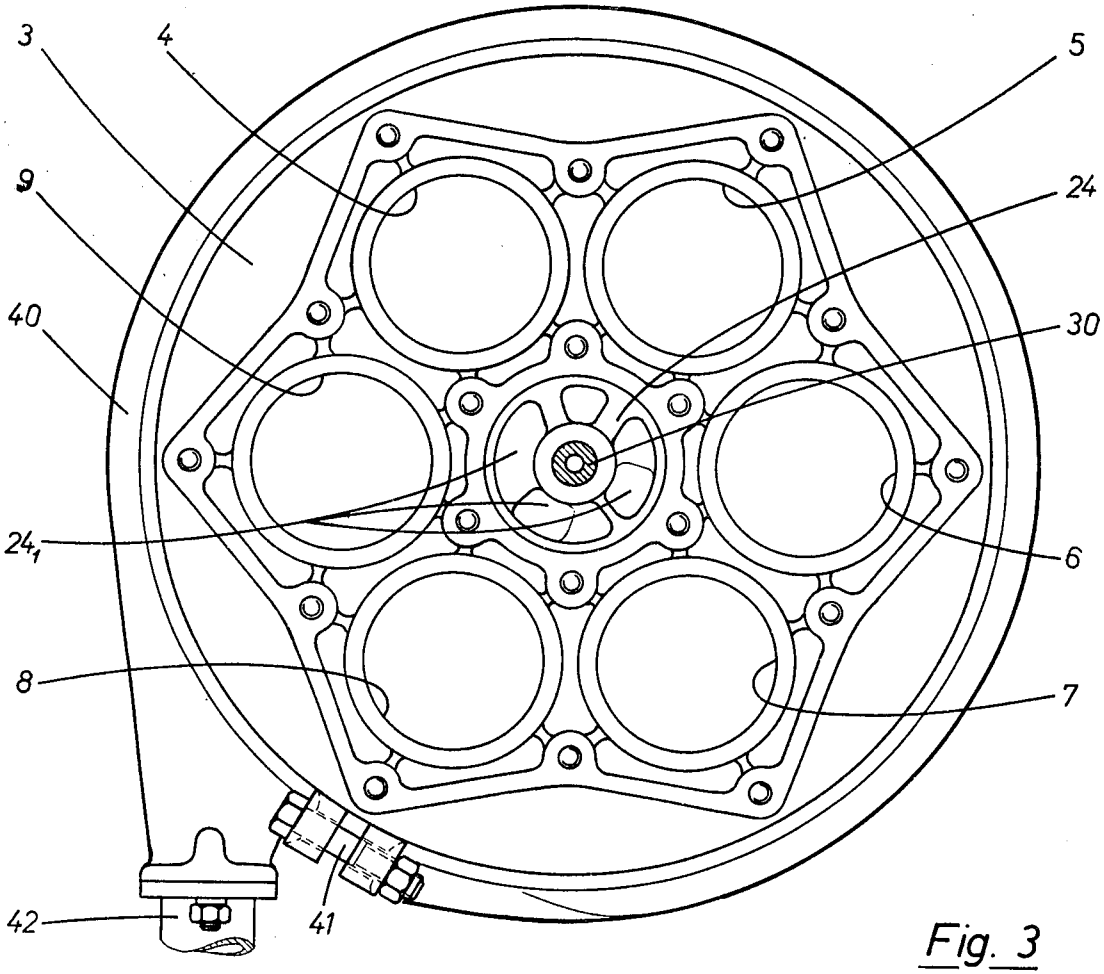
FIG. 3 is a plan view of the engine of FIGS. 1 and 2 with the cylinder head removed.

In the engine shown in FIGS. 1 to 6, numeral 1 designates the upper part of the crank case. Cylinder block 3 which is the housing for the working cylinders, fixed by bolts 2, includes the six working cylinder bores 4 to 9 and a central cavity formed by internal cylindrical surface 10 for receiving the rotary distributor 24 and mating with the outer cylindrical surface thereof. Crank case top 1 and crank case bottom 11 support the three crank shafts 12, 13 and 14 in needle bearings, said shafts being interconnected via gears 15, 16 and 17. In the present example, gear 17 simultaneously drives drive gear 18 which, via tube 19, drives shaft 20 which is elastic in rotation, and the car axle drive 21 with the shift (not illustrated).

Pistons 23 are connected to the crank shafts via rods 22. Rotary distributor 24 is driven in rotation by the middle gear 16, via a spur gear 25 and two bevel gears 26 and 27. In the center of the cylinder head 28, in which the spark plugs 29 are seated, there is a fuel supply nozzle 30, which leads into a chamber $24_2$ in the rotary distributor 24. Fuel supply 30 is fixed in place and sealed by a packing 31 against cylinder head bore $28_1$. Combustion air is delivered via a conduit 32 cast together with the cylinder head, and an annular conduit 33, to a blade formed interior cavity $24_1$ forming internal passageways within rotary distributor 24. From cavity $24_1$ the combustion air enters the working cylinders via ports 37 which, at appropriate times, communicates with the upper part of cavity $24_1$. Combustion air also flows into the crank chambers beneath the pistons via rotary distributor cavity $24_1$ and via crank chamber conduits 34. Delivery performance of the crank chambers is enhanced by the helicoidal configuration of the internal passageways of rotary distributor 24.

Air delivered to the cylinder crank chambers by rotary distributor passageway conduit $24_1$ and crank chamber conduits 34, with a suitable setting of the rotary distributor, goes in the scavenging process via the same crank chamber conduits 34 into overflow passageway $24_7$ disposed in the rotary distributor 24. This situation is best illustrated in FIG. 6. In the rotary distributor setting that is shown here, the crank chambers of cylinders 5 and 6 are filled whereas the compressed air in the crank chamber of cylinder 9 is forced via the crank chamber conduit 34, via overflow passage $24_7$, into working cylinder 4. This overflow in the plane of the intake ports is shown in FIG. 4, wherein intake ports that lead tangentially into the working cylinder are designated 37 and the crank chamber conduits 34 are indicated with dashed lines. The scavenging air flows tangentially upward at a slant via the discharge ports in the direction of arrow 38, into cylinder 4. The discharge ports, which in the example of FIGS. 1 to 6 are controlled exclusively by the working piston, are designated 39. Exhaust gases flow into a manifold exhaust ring 40 formed as a clamping ring, enclosing the cylinder block, said ring 40 being bolted on by clamping bolts 41 that are cast together with it, onto exhaust pipe 42.

Fuel continuously injected by fuel supply nozzle 30 penetrates into a chamber $24_2$ in the rotary distributor and there, as shown in the partial cross section of FIG. 5, it is mixed with the hot highly compressed gas jet which enters through short channel 35 of cylinder 5 via recess $24_3$ into channel $24_4$ of the rotary distributor. In chamber $24_2$, the injected fuel is entrained in the turbulence of the gas jet, as indicated by arrow 36. The fuel of the rich gas-fuel mixture is thereby vaporized and shot by the excess pressure from cylinder 5 through channel $24_5$, recess $24_6$, via short channel 35 into cylinder 4 directly onto its spark plug. Shortly after closure of channel 35 of cylinder 5, there is ignition there of the mixture. The rotary distributor then connects cylinder 4, which meanwhile has become highly compressed, with cylinder 9 which is in the initial phase of compression, and the same process which occurred between cylinders 5 and 4 is repeated between cylinders 4 and 9.

Figure 11:
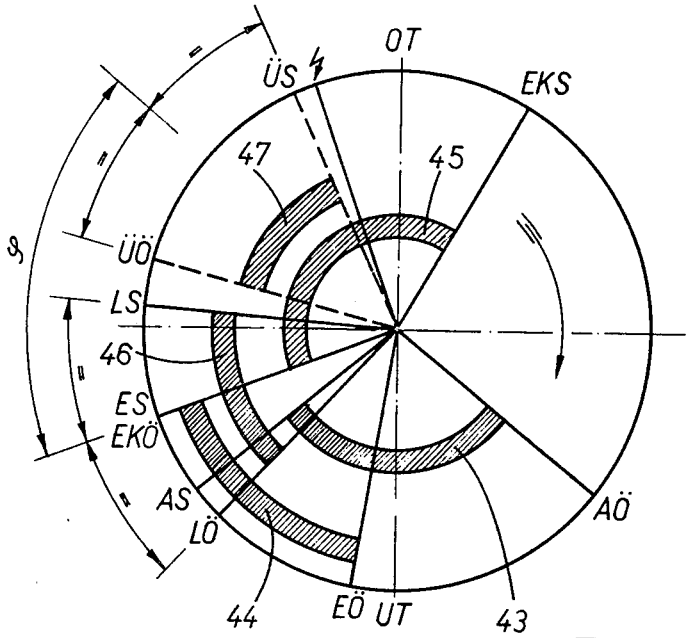
FIG. 11 is a control diagram for the engine of FIGS. 1–6.

Operation of the engine of FIGS. 1 through 6 is shown by reference to the control diagram of FIG. 11. The abbreviations used there have the following meanings: OT=upper dead center, UT—lower dead center of the working piston, EO=intake opens, LO=charge opens, AS=exhaust closes, EKO=intake crank chamber opens, ES=intake closes, LS=charge closes, UO=overflow conduit opens, US=overflow conduit closes, EKS=intake crank chamber closes, AO=discharge opens.

Angle $\rho$ in the diagram is 60° in the case of a six-cylinder engine. The hatched angle fields indicate the following: 43 is the exhaust discharge portion and is determined by the height of the exhaust port; 44 is the air intake portion, the start of which occurs by rotation rotary distributor 24 and closure of which by working piston 23. 45 is the portion during which the crank chamber conduit 34 is opened, and this is controlled by rotary distributor 24. 46 is the portion over which the rich mixture is shot into the cylinder, also controlled by rotary distributor 24. Finally, arc 47 limited by dashed lines indicates the portion during which the compressed fuel mixture is taken to the following cylinder, from the leading cylinder or from the cylinder for which the rest of the diagram values apply.

Figure 7:
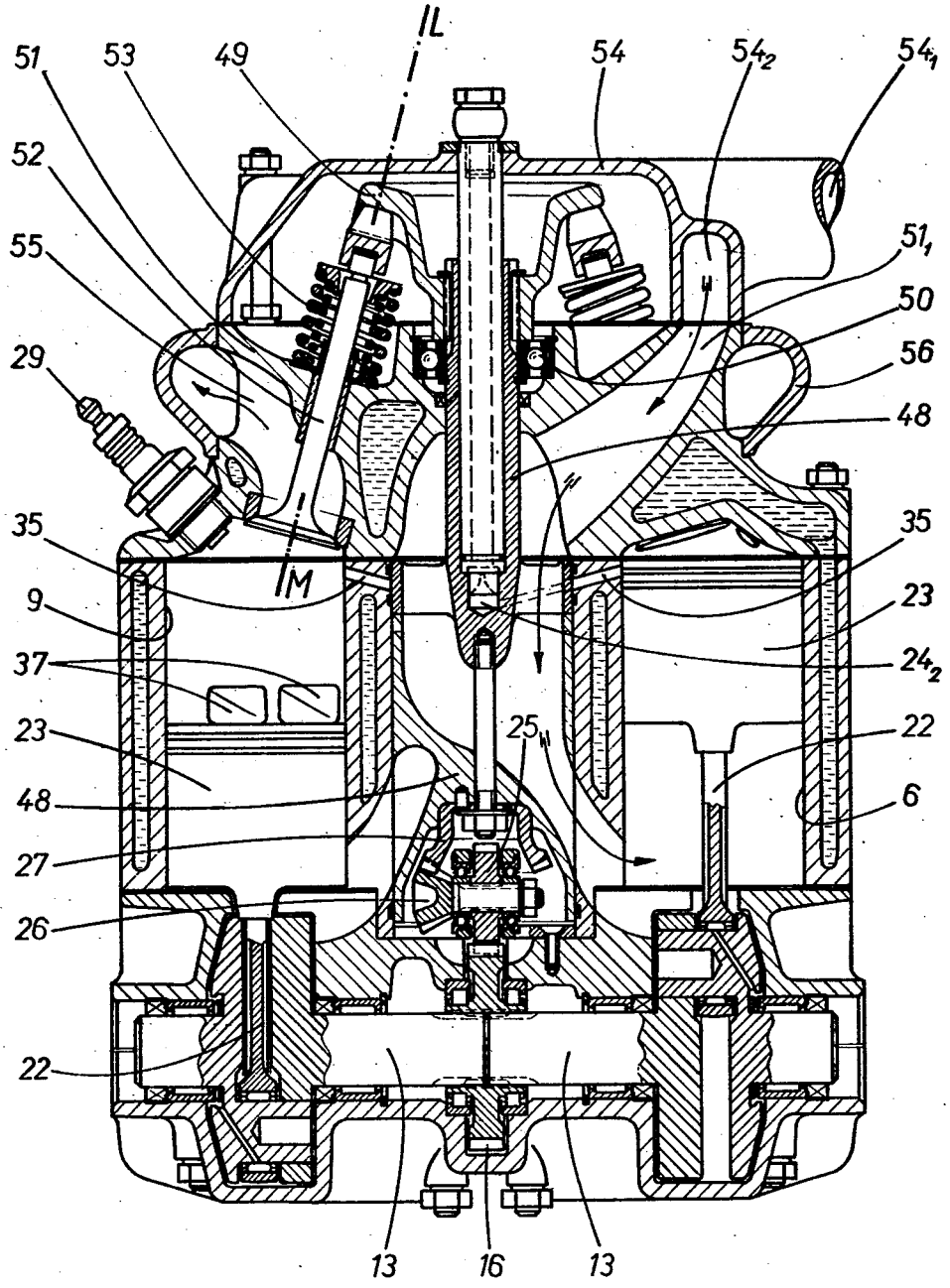
FIG. 7 is a vertical central sectional view taken through a two-stroke multicylinder internal combustion engine and showing another embodiment of the present invention.
Figure 12:
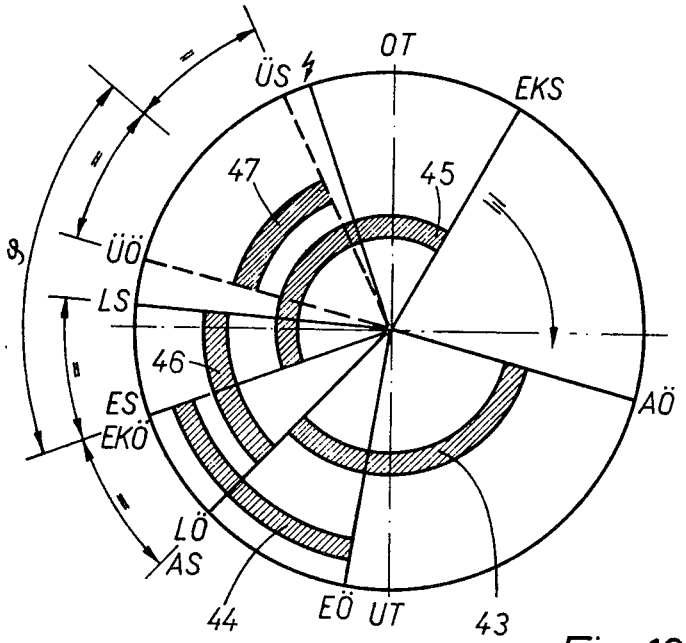
FIG. 12 is a control diagram for the engine of FIGS. 7–9.

In the engine of FIGS. 7 to 9, discharge is controlled by valves, and its operation is shown by the control diagram of FIG. 12. Explanation and the reference numerals of FIG. 11 are applicable here also, with the exception that here AO and AS are controlled by discharge valves. The drive parts of this engine are the same as in the engine of FIGS. 1 to 6, and are therefore given the same reference numerals. The lower part of the rotary distributor, insofar as air delivery passages are concerned, is also made like the rotary distributor of the engine of FIGS. 1 to 6. Here the rotary distributor, designated 48, has a tubular extension $48_1$ on which is mounted bevelled cam 49. Extension $48_1$ and cam 49 are mounted on the cylinder head 51 via a ball bearing 50 in a cylinder head 51 which receives valves 52 with valve springs 53. Discharge conduits 55 lead from the valve seat to exhaust ring 56 which, as with ring 40 of FIGS. 1 through 6, is made as a clamping ring.

Valve hood 54 which covers the valves and their drives contains air connections $54_1$ from which the air sucked via annular conduit $54_2$ into passages $51_1$ flows to rotary distributor 48. The engine combustion process follows in the same way as in the engine of FIGS. 1 to 6, and as illustrated in the control diagram of FIG. 12, with the exception of the valve discharge.

FIG. 8 shows the cylinder head of this valve-controlled two-stroke engine with valve hood 54 and exhaust ring 56 removed, in top view. The valves, as shown in FIG. 9, are actuated by cams 49, by traction levers 57 with spherical cup supports $57_1$.

Figure 10:
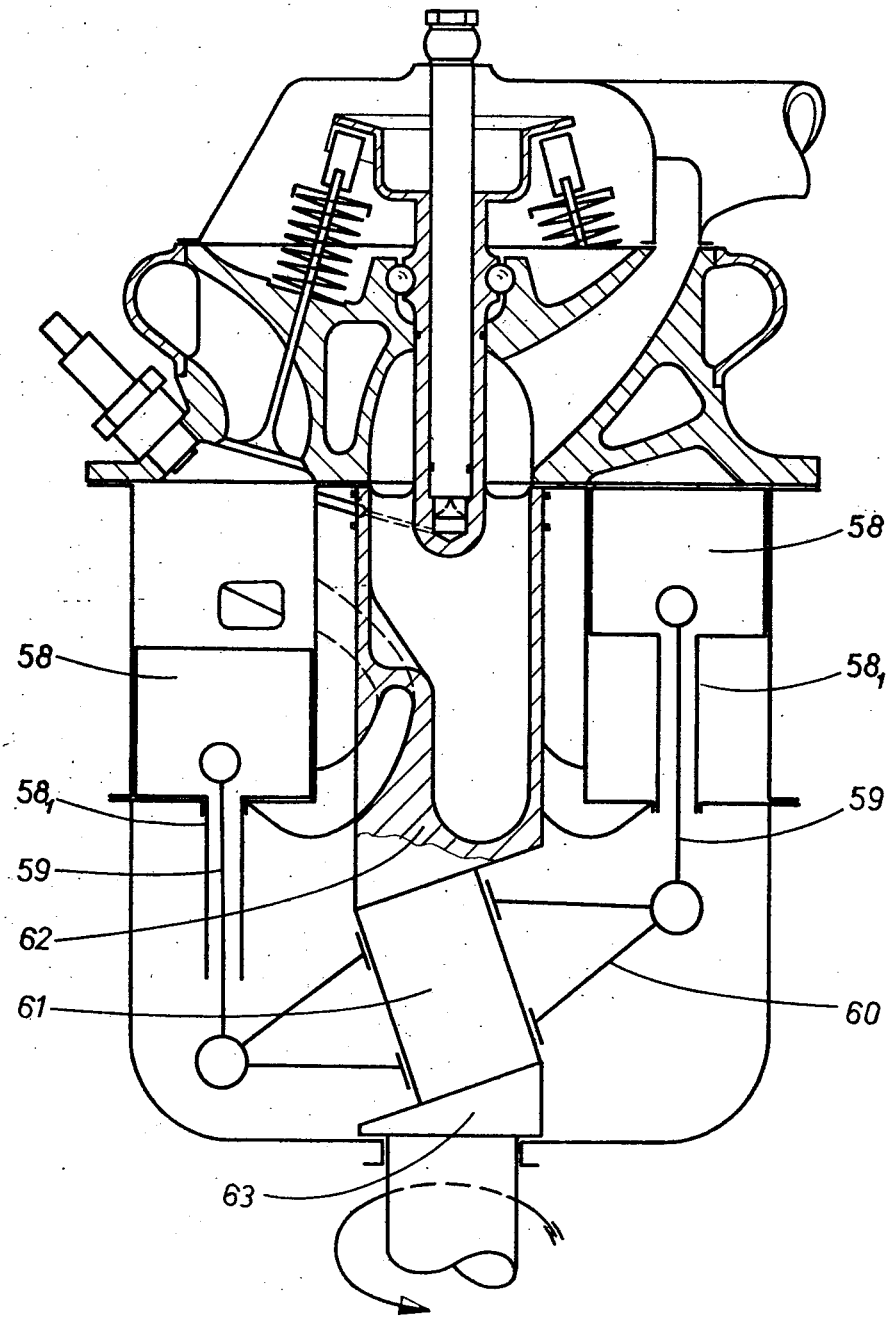
FIG. 10 is a schematic central sectional view similar to FIGS. 2 and 7 but showing another embodiment of the present invention in which the crank shafts are replaced by a single wobble plate.

FIG. 10 shows an example of another embodiment of the invention in which, instead of crank shafts there is a wobble plate drive. Lift pistons 58 here have cylindrical projections $58_1$ which engage rods 59. Space 60 below the lift pistons serves for combustion air supply and thus takes over the function of the crank chambers of the engine of the first example. In the illustrated example, the engine cylinder head, as in FIGS. 7 to 9 includes a valve discharge. It will be apparent that this wobble plate engine can also be equipped with discharge ports in lieu of valves.

Rods 59 are connected to wobble plate 60 by spherical connections. The wobble plate is held fixedly, in the peripheral direction, and slides on slanted crank 61 of crank shaft 63 which is coupled with rotary distributor 62, and by its wobble motion, which is initiated by the working pistons, it creates the drive moment for crank shaft 63. The combustion process functions proceed as in the above described engines. This version of the engine of the invention can also be equipped with an unequal number of working cylinders.

Although the invention has been described in considerable detail with respect to preferred embodiments thereof, it will be apparent that the invention is capable of numerous modifications and variations apparent to those skilled in the art, without departing from the spirit and scope of the invention.

I claim:

1. A two-stroke internal combustion engine comprising:

a plurality of reciprocating piston working cylinders having their axes parallel to each other and arranged equiangularly in a circle about a central cavity, a rotary distributor located in said central cavity and rotatable about a central axis parallel to said working cylinder axes, said rotary distributor having an outer cylindrical surface mating with an inner cylindrical surface which is fixed with respect to the working cylinders, means for rotating the rotary distributor in timed relationship with the reciprocating motion of the pistons, said rotary distributor including internal passageways leading to the ports on its outer cylindrical surface, and said inner cylindrical surface including ports communicating with the working cylinders and mating with the ports on the outer cylindrical surface of the rotary distributor at certain times during the rotation of the latter, whereby at least one combustion process function of the working cylinders is controlled by the rotary distributor, and including means for delivering intake air into the rotary distributor, and said internal passageways arranged to deliver said air through said ports and into the working cylinders upon rotation of the rotary distributor.

2. An engine according to claim 1, including means for delivering fuel into the rotary distributor, and including channels in the rotary distributor which receive the fuel and charge it through ports in said outer cylindrical surface of the rotary distributor and further ports in the said inner cylindrical surface, to the working cylinders upon rotation of the rotary distributor.

3. An engine according to claim 2, said internal passageways further including means for conveying compressed air into each working cylinder in addition to said intake air for purposes of scavenging that working cylinder, and said channels positioned to charge the fuel into each working cylinder such that it mixes with the scavanging air therein.

4. An engine according to claim 3, said internal passageways including: a fresh air inlet, a cavity, ports leading from the cavity which form the said ports to the working cylinders, further ports leading from the cavity into the crank chambers which are those spaces beneath the pistons on the sides thereof opposite from the combustion portion of each working cylinder, said crank chambers being closed off such that air delivered thereto becomes compressed upon movement of the piston thereinto, and a duct leading through the rotary distributor placing a crank chamber under pressure in communication with another working cylinder for delivery of the air compressed in that crank chamber to the other working cylinder as scavanging air therein.

5. An engine according to claim 4, including a cylinder head covering the end of the working cylinders, and including a conduit leading through the head and into the said cavity of the rotary distributor.

6. An engine according to claim 5, said working cylinders including discharge ports formed into the wall of the working cylinder.

7. An engine according to claim 4, said working cylinders including air discharge valves.

8. An engine according to claim 4, including six working cylinders, the pistons of two of those cylinders connected to a first crankshaft, the pistons of two other cylinders connected to a second crankshaft, the pistons of the remaining two cylinders connected to a third crankshaft, the three crankshafts being parallel to each other and innerconnected to drive a single output shaft.

9. An engine according to claim 4, wherein the pistons of all cylinders are connected to a common wobble plate which comprises the output shaft.

10. An engine according to claim 1, said internal passageways further including means for conveying compressed air into each working cylinder in addition to said intake air, for purposes of scavenging the working cylinder.

11. An engine according to claim 10, said internal passageways including: a fresh air inlet, a cavity, ports leading from the cavity which form the said ports to the working cylinders, further ports leading from the cavity into the crank chambers which are those spaces beneath the pistons on the sides thereof opposite from the combustion portion of each working cylinder, said crank chambers being closed off such that air delivered thereto becomes compressed upon movement of the piston thereinto, and a duct leading through the rotary distributor placing a crank chamber under pressure in communication with another working cylinder for delivery of the air compressed in that crank chamber to the other working cylinder as scavenging air therein.

12. An engine according to claim 11, wherein those portions of the passageway leading from the cavity to the crankshaft and the said duct are helical.

13. An engine according to claim 1, said working cylinders including discharge ports formed into the walls of the working cylinders.

14. An engine according to claim 13, said discharge ports located on the side of the working cylinder wall opposite from the rotary distributor, and including an outlet manifold in the form of a ring connected with all discharge ports and encircling the engine.

15. An engine according to claim 1, said working cylinders including air discharge valves.

16. An engine according to claim 15, including a cam operatively connected to the rotary distributor and operatively contacting the discharge valves to control operation of the valves in timed relation to rotation of the rotary distributor.

17. An engine according to claim 1, including a cylinder head covering all of the working cylinders, and including a conduit leading through the head and into the internal passageways of the rotary distributor.

18. An engine according to claim 1, wherein the internal passageways within the rotary distributor are helical.

19. An engine according to claim 1, including six working cylinders, the pistons of two of those cylinders connected to a first crankshaft, the pistons of two other cylinders connected to a second crankshaft, the pistons of the remaining two cylinders connected to a third crankshaft, the three crankshafts being parallel to each other and interconnected to drive a single output shaft.

20. An engine according to claim 19, the center one of the three crankshafts drivingly engaged with the rotary distributor to rotate the same.

21. An engine according to claim 1, wherein the pistons of all cylinders are connected to a common wobble plate which comprises the output shaft.

22. An engine according to claim 21, including means drivingly connecting the wobble plate and the rotary distributor to drive the latter from the former.

23. An engine according to claim 1, including means for delivering fuel to the rotary distributor, and said internal passageways forming fuel distribution channels for delivering fuel from the rotary distributor, via said ports, to the working cylinders upon rotation of the rotary distributor.

24. An engine according to claim 23, including a fuel chamber positioned to receive fuel delivered to the rotary distributor and a pair of channels leading from the said chamber and spaced apart at an angle to establish communication between adjacent cylinders, taken in ignition sequence, such that pressurized air from a working cylinder under compression can force air through one channel and then through the chamber and out the other channel to urge fuel from the chamber out into the other working cylinder as a rich fuel mixture.

25. A two-stroke internal combustion engine comprising:

a plurality of reciprocating piston working cylinders having their axes parallel to each other and arranged equiangularly in a circle about a central cavity, a rotary distributor located in said central cavity and rotatable about a central axis parallel to said working cylinder axes, said rotary distributor having an outer cylindrical surface mating with an inner cylindrical surface which is fixed with respect to the working cylinders, means for rotating the rotary distributor in timed relationship with the reciprocating motion of the pistons, said rotary distributor including internal passageways leading to the ports on its outer cylindrical surface, and said inner cylindrical surface including ports communicating with the working cylinders and mating with the ports on the outer cylindrical surface of the rotary distributor at certain times during the rotation of the latter, whereby at least one combustion process function of the working cylinders is controlled by the rotary distributor, and including six working cylinders, the pistons of two of those cylinders connected to a first crankshaft, the pistons of two other cylinders connected to a second crankshaft, the pistons of the remaining two cylinders connected to a third crankshaft, the three crankshafts being parallel to each other and interconnected to drive a single output shaft.

26. An engine according to claim 25, the center of the three crankshafts drivingly engaged with the rotary distributor to rotate the same.

27. A two-stroke internal combustion engine comprising:

a plurality of reciprocating piston working cylinders having their axes parallel to each other and arranged equiangularly in a circle about a central cavity, a rotary distributor located in said central cavity and rotatable about a central axis parallel to said working cylinder axes, said rotary distributor having an outer cylindrical surface mating with an inner cylindrical surface which is fixed with respect to the working cylinders, means for rotating the rotary distributor in timed relationship with the reciprocating motion of the pistons, said rotary distributor including internal passageways leading to the ports on its outer cylindrical surface, and said inner cylindrical surface including ports communicating with the working cylinders and mating with the ports on the outer cylindrical surface of the rotary distributor at certain times during the rotation of the latter, whereby at least one combustion process function of the working cylinders is controlled by the rotary distributor, and including means for delivering fuel to the rotary distributor, and said internal passageways forming fuel distribution channels for delivering fuel from the rotary distributor, via said ports, to the working cylinders upon rotation of the rotary distributor.

28. An engine according to claim 27, including a fuel chamber positioned to receive fuel delivered to the rotary distributor and a pair of channels leading from the said chamber and spaced apart at an angle to establish communication between adjacent cylinders, taken in ignition sequence, such that pressurized air from a working cylinder under compression can force air through one channel and then through the chamber and out the other channel to urge fuel from the chamber out into the other working cylinder as a rich fuel mixture.

* * * * *